US006435157B1

(12) United States Patent
Zaremba et al.

(10) Patent No.: US 6,435,157 B1
(45) Date of Patent: Aug. 20, 2002

(54) SUPPORT FOR AN ACCESSORY OF AN INTERNAL COMBUSTION ENGINE AND METHOD OF MAKING SAME

(75) Inventors: Dieter Zaremba, Mühlacker; Klaus Schneider, Tiefenbronn, both of (DE)

(73) Assignee: AG, Ing. h.c.F. Porsche, Stuttgart (DE)

( * ) Notice: Subject to any disclaimer, the term of this patent is extended or adjusted under 35 U.S.C. 154(b) by 17 days.

(21) Appl. No.: 09/654,883

(22) Filed: Sep. 5, 2000

(30) Foreign Application Priority Data

Sep. 4, 1999 (DE) ..... 199 42 275

(51) Int. Cl.[7] ..... F02F 7/00

(52) U.S. Cl. ..... 123/198 R; 123/195 R; 123/195 C

(58) Field of Search ..... 123/53.3, 53.6, 123/195 R, 195 A, 195 C, 198 R, 198 C, 41.44, 41.01, 41.1

(56) References Cited

U.S. PATENT DOCUMENTS

| | | | | | |
|---|---|---|---|---|---|
| 3,730,147 | A | | 5/1973 | Buchwald | 123/41.44 |
| 4,370,957 | A | | 2/1983 | Skatsche | 123/196 AR |
| 4,977,870 | A | * | 12/1990 | Hashimoto et al. | 123/195 C |
| 5,000,142 | A | * | 3/1991 | Aruga et al. | 123/195 C |
| 5,074,255 | A | * | 12/1991 | Ebesu et al. | 123/41.74 |
| 5,078,106 | A | * | 1/1992 | Matsuo et al. | 123/196 R |
| 5,125,376 | A | * | 6/1992 | William et al. | 123/195 A |
| 5,503,118 | A | * | 4/1996 | Hollis | 123/41.44 |
| 5,666,930 | A | | 9/1997 | Elder | 123/568 |
| 5,692,466 | A | * | 12/1997 | Hausmann et al. | 123/195 A |
| 5,704,329 | A | * | 1/1998 | Bublitz et al. | 123/195 A |
| 6,109,221 | A | * | 8/2000 | Higgins et al. | 123/41.74 |
| 6,125,799 | A | * | 10/2000 | Van Son et al. | 123/41.31 |
| 6,196,166 | B1 | * | 3/2001 | Yonezawa | 123/41.01 |

FOREIGN PATENT DOCUMENTS

| | | |
|---|---|---|
| DE | 3048449 | 2/1983 |
| DE | 33 41 119 | 6/1985 |
| DE | 4136773 | 12/1992 |
| DE | 4214799 | 11/1993 |
| DE | 4433247 | 3/1996 |
| DE | 19633485 | 3/1998 |
| DE | 19732370 | 2/1999 |
| EP | 0811756 | 12/1997 |

OTHER PUBLICATIONS

Copy of German Office Action dated Apr. 10, 2001.

* cited by examiner

*Primary Examiner*—Tony M. Argenbright
*Assistant Examiner*—Hai H. Huynh

(57) ABSTRACT

A support is constructed for holding an accessory of an internal combustion engine and for guiding an operating medium of the internal combustion engine. In order to expand the range of applications of the support, it is designed for accommodating several accessories and for guiding cooling liquid from a cylinder housing to a radiator.

18 Claims, 3 Drawing Sheets

SUPPORT FOR AN ACCESSORY OF AN INTERNAL COMBUSTION ENGINE AND METHOD OF MAKING SAME

BACKGROUND AND SUMMARY OF THE INVENTION

This application claims the priority of German Patent Document 199 42 275.3, filed Sep. 4, 1999, the disclosure of which is expressly incorporated by reference herein.

The invention relates to a support of an internal combustion engine which is constructed for guiding an operating medium of the engine.

A supporting arm for an internal combustion engine is known from German Patent Document DE 33 41 119 C1 and is attached to the exhaust gas turbo charger. The support arm, which is supported at a crankcase of the internal combustion engine, comprises a device for de-foaming and degassing the lubricating oil leaving the exhaust gas turbo charger. The device is provided with a chamber, which is integrated in the support arm and connected over a pipeline with the exhaust gas turbo charger.

It is an object of the invention to provide a support for an internal combustion engine which, when accommodating an accessory efficiently, can be fitted advantageously to the internal combustion engine and, at the same time, acts as a guiding organ for an operating medium.

Pursuant to the invention, this objective is achieved by providing a support for an accessory of an internal combustion engine, which is constructed for guiding an operating medium of the internal combustion engine, wherein the support, is adapted to accommodate a plurality of several accessories, and is connected with a housing of the internal combustion engine, said support being constructed for guiding cooling liquid from a cylinder housing to a radiator for said cooling liquid.

Further advantageous features of preferred embodiments of the invention are described herein and in the claims.

The advantages mainly achieved with the invention are that the support, on the one hand, accommodates and holds in position several accessories, such as the generator, the air conditioning compressor, the power steering pump, etc. and, on the other hand, passes cooling fluid in a clear manner over a partial region between the cylinder housing and a radiator. At the same time, the support can be mounted at the internal combustion engine having opposite rows of cylinders. This makes the installation of the support particularly advantageous in a motor vehicle, especially in a passenger car. The support can be constructed as a casting and optimized with proven means with respect to weight and production costs.

Other objects, advantages and novel features of the present invention will become apparent from the following detailed description of the invention when considered in conjunction with the accompanying drawings.

DETAILED DESCRIPTION OF THE DRAWINGS

Figure 1:
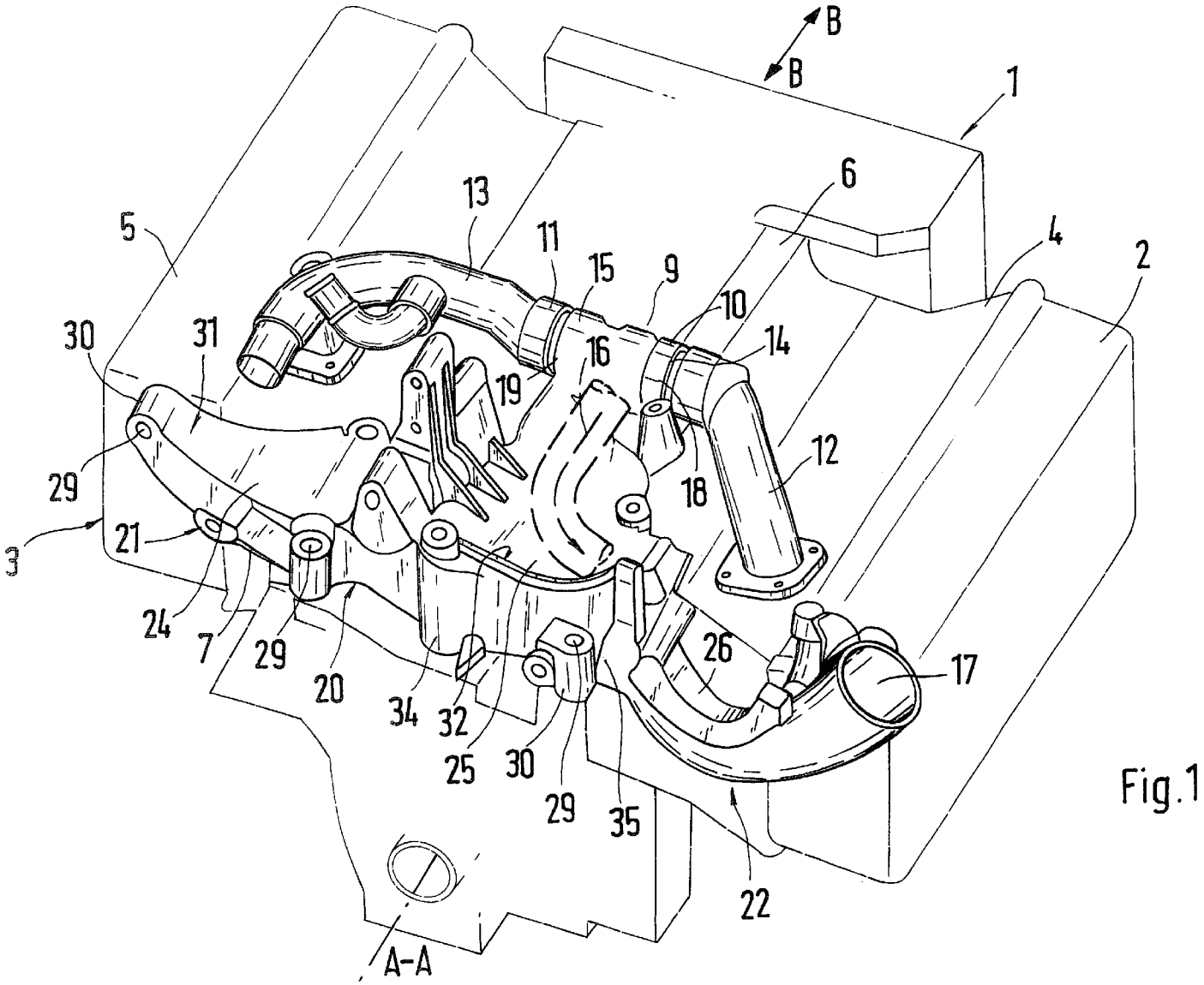
FIG. 1 is an oblique perspective schematic view from the side and from above of an internal combustion engine with a support, constructed in accordance with preferred embodiments of the inventions.
Figure 2:
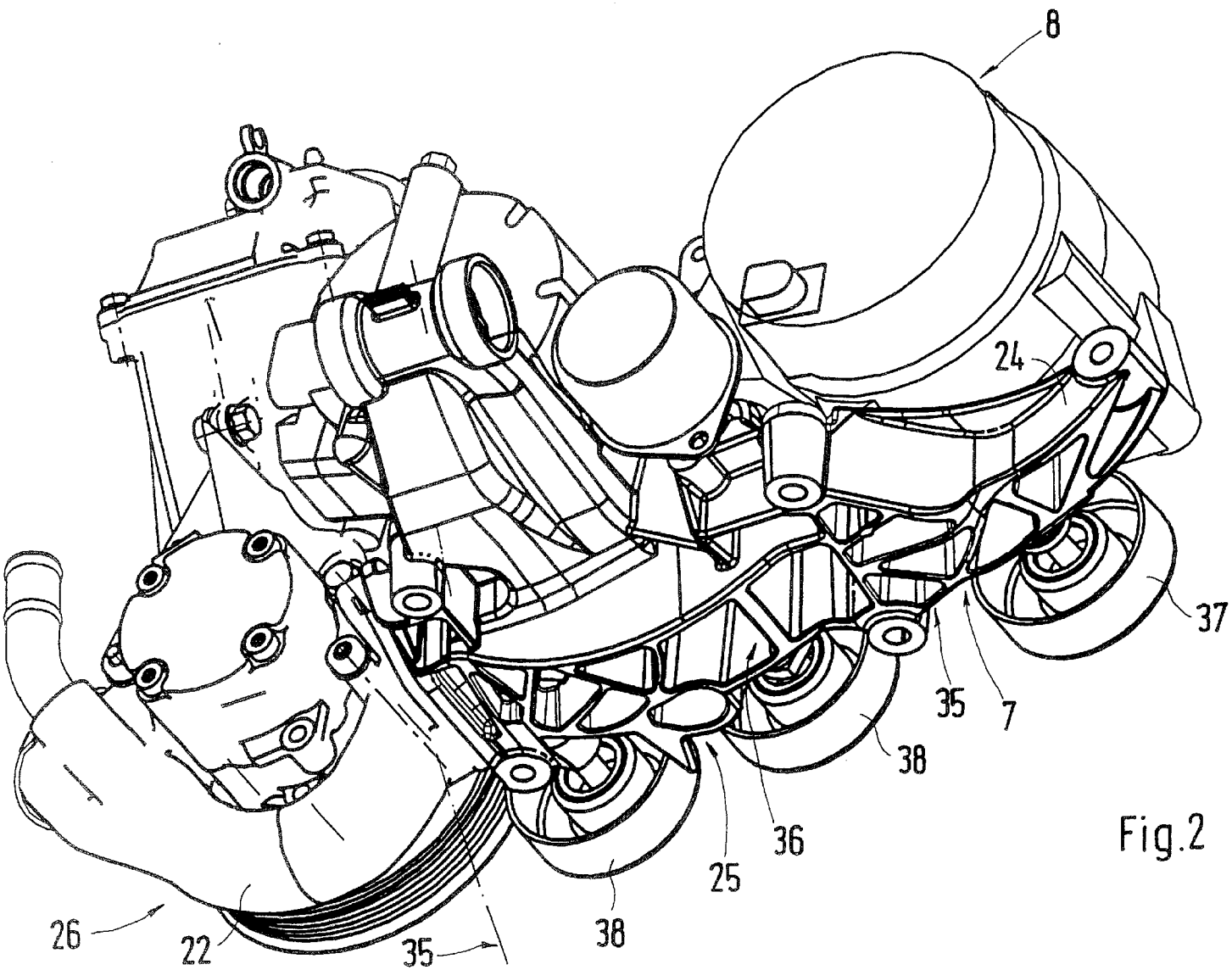
FIG. 2 is an oblique perspective schematic view from the side and from below of the support of FIG. 1.

A liquid-cooled internal combustion engine 1 of the piston type, which is suitable for being mounted in a passenger car, has horizontally opposed rows of cylinders 2, 3 with cylinder housings 4, 5 for a horizontally opposed engine. Between the cylinder rows 2, 3, a crankcase housing 6 extends, in which a crank shaft, the details of which are not shown, extends in a central longitudinal plane A—A.

Above the crankcase housing 6, a support 7 extends which, on the one hand, serves for attaching several accessories 8 and, on the other, is constructed for guiding cooling liquid. The support 7 extends with a longitudinal section 9 between the cylinder housings 4, 5 and has connecting pieces 10, 11 for pipelines 12, 13. The pipelines 12, 13 are connected with the cylinder housings 4, 5 and the connecting pieces 10, 11; the latter serve as inlets 14, 15 for the cooling water from the cylinder housings 4, 5. The cooling water passes through a duct 16, which is in the support 7 and shown by lines of dots and dashes, and reaches an outlet 17, which is remote from the in lets 14, 15 and from which it is passed to a radiator, which is not shown, of the liquid-cooled internal combustion engine 1. In the example shown, ends 18, 19 of the connecting pieces 10, 11 are aligned approximately transversely to the longitudinal median plane A—A of the internal combustion engine; likewise the pipelines 12, 13. At a distance from the connecting pieces 10, 11, as seen in the longitudinal direction B—B of the internal combustion engine 1, a transverse section 20 is integrally molded at the support 7. The transverse section 20 comprises a first transverse arm 21 and a second transverse arm 22, the outlet 17 being provided at the second transverse arm 22. The transverse section 20 is provided with seats 24, 25, 26 for the accessories 8, which are represented, for example, by a generator 27, an air conditioner compressor 28 and a power steering pump 28. The seats 23, 24, 25 are provided with openings 29 for fastening screws. The openings 29 extend at least partially into bearing hubs 30. At cylindrical housings 27, 28, 29, the seats 24, 25, 26 have shaped sections 31, 32, 33, which are fitted to the accessories 8 and surround the housings 27, 28, 29 only regionally.

For manufacturing and installation reasons, the second transverse arm 22 may be detachable. For this purpose, a parting plane 35, to which the transverse arm 22 is connected, is provided at the transverse section 20 adjacent to a middle part 34. The support 7, which can be a casting consisting of an aluminum alloy, is constructed as a hollow body in the region of the duct 16. Outside of this region, for example, at 35, it is possible to provide the support 7 with a cross section, which is in the shape of an open U and reinforced by means of ribs 36.

Figure 3:
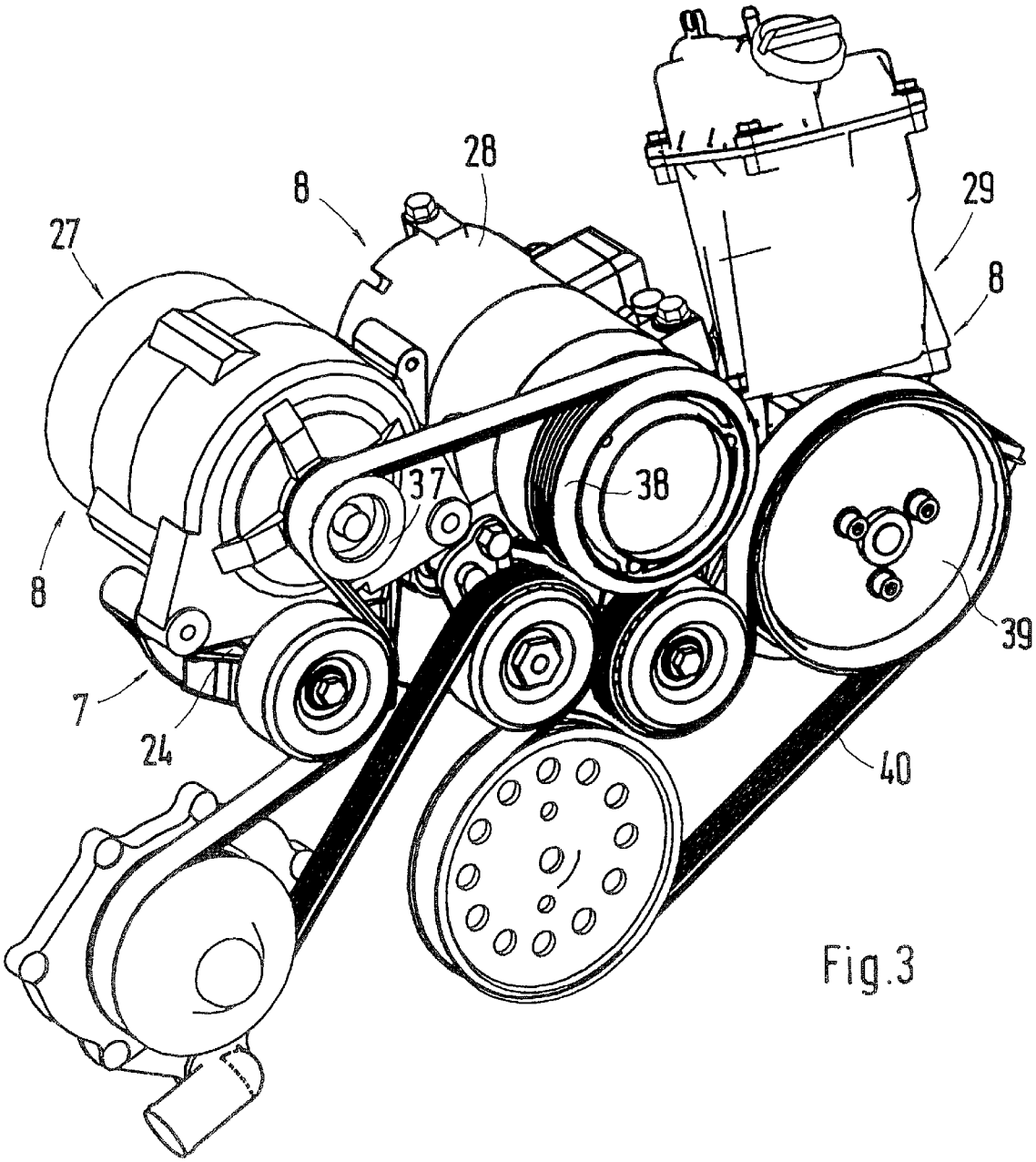
FIG. 3 is an oblique perspective schematic view from the side and from above of accessories of the internal combustion engine, which are connected with the support of the assembly of FIGS. 1 and 2.

Finally, it is evident from FIG. 3, that the driving wheels 37, 38, 39 of the accessories 8 act together with a common looping drive 40.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A support for an internal combustion engine with a housing, which has opposite rows of cylinders with cylinder housings, wherein the support passes at least sectionally between the cylinder housings and has connecting pieces for pipelines which are placed between the connecting pieces and the cylinder housings, the connecting pieces being constructed as inlets for cooling water from the cylinder housings, which cooling water reaches an outlet over a duct in the support, wherein ends of the connecting pieces are aligned approximately transversely to a longitudinal median plane of the internal combustion engine.

2. The support of claim 1, wherein the support includes a transverse section which is provided with seats for a plurality accessories.

3. The support of claim 1, wherein the support is constructed as a hollow body casting for guiding cooling water.

4. The support of claim 1, wherein the accessories have driving wheels, which act together with a common looping drive.

5. A support for an internal combustion engine with a housing, which has opposite rows of cylinders with cylinder housings, wherein the support passes at least sectionally between the cylinder housings and has connecting pieces for pipelines which are placed between the connecting pieces and the cylinder housings, the connecting pieces being constructed as inlets for cooling water from the cylinder housings, which cooling water reaches an outlet over a duct in the support, wherein the pipelines are aligned approximately transversely to a longitudinal median plane of the internal combustion engine.

6. The support of claim 5, wherein the support includes a transverse section which is provided with seats for a plurality accessories.

7. A support for an internal combustion engine with a housing, which has opposite rows of cylinders with cylinder housings, wherein the support passes at least sectionally between the cylinder housings and has connecting pieces for pipelines which are placed between the connecting pieces and the cylinder housings, the connecting pieces being constructed as inlets for cooling water from the cylinder housings, which cooling water reaches an outlet over a duct in the support wherein a transverse section with a first transverse arm and a second transverse arm extends at a distance from the connecting pieces at the support, at least one transverse arm encircling the outlet.

8. The support of claim 7, wherein the support includes a transverse section which is provided with seats for a plurality accessories.

9. The support of claim 7, wherein at least the second transverse arm is constructed detachably.

10. The support of claim 9, wherein the second transverse arm is taken to a parting plane of a middle piece of the transverse section.

11. The support of claim 10, wherein the second transverse encircles the outlet.

12. A support for an internal combustion engine with a housing, which has opposite rows of cylinders with cylinder housings, wherein the support passes at least sectionally between the cylinder housings and has connecting pieces for pipelines which are placed between the connecting pieces and the cylinder housings, the connecting pieces being constructed as inlets for cooling water from the cylinder housings, which cooling water reaches an outlet over a duct in the support, wherein the support includes a transverse section which is provided with seats for a plurality of accessories.

13. The support of claim 12, wherein the seats are configured to accommodate a generator, an air conditioner compressor, and a power steering pump.

14. The support of claim 12, wherein the seats are provided with openings for attaching the accessories.

15. The support of claim 14, wherein the seats have shaped sections fitting the housings of the accessories.

16. A method of making an engine assembly, comprising: providing an engine housing with opposed cylinder housings at respective opposite sides of a central plane through the engine housing, casting a support member with support points for supporting a plurality of engine accessories and with a coolant flow passage and connecting the support member with the engine housing and with the coolant flow passage connected with respective coolant flow passages in the cylinder housing, and detachably attaching a transverse arm to the support member, said transverse arm having a hollow coolant accommodating space connected at one end to the coolant flow passage and an opposite coolant flow outlet end.

17. An engine assembly comprising:

an engine housing with opposed cylinder housings at respective opposite sides of a central plane extending transversely with respect to the opposed cylinder housing, and an integrally formed support member connected to the engine housing, said support member including:

a coolant flow passage communicating with coolant flow from the cylinder housing; and means for accommodating attachment of a plurality of accessories to said support member.

18. An engine assembly according to claim 17, wherein said means for accommodating attachment of a plurality of accessories includes means for attaching a generator, an air conditioner compressor, and a power steering pump.

* * * * *